US006105795A

United States Patent [19]

Terragni

[11] Patent Number: 6,105,795

[45] Date of Patent: Aug. 22, 2000

[54] UPWARDLY/DOWNWARDLY MOVABLE CLOTHES-HANGER DEVICE

[76] Inventor: Ezio Terragni, Via Privata Golf 3, Lentate sul Seveso (Milan), Italy

[21] Appl. No.: 08/980,409

[22] Filed: Nov. 28, 1997

[30] Foreign Application Priority Data

Nov. 29, 1996 [IT] Italy ..... MI96A2492

[51] Int. Cl.[7] ..... A47H 1/124

[52] U.S. Cl. ..... 211/100; 211/88.04; 211/105.1; 211/123; 211/171

[58] Field of Search ..... 211/99, 100, 104, 211/170, 171, 172–173, 88.04, 96, 165, 105.1, 123; 248/240, 240.1–240.4, 291.1

[56] References Cited

U.S. PATENT DOCUMENTS

| | | | |
|---|---|---|---|
| 1,430,755 | 10/1922 | Roberson | 211/99 |
| 1,705,203 | 3/1929 | Patterson | 211/105.1 |
| 2,550,158 | 4/1951 | McCormick | 211/100 |
| 2,597,115 | 5/1952 | Lundstrum | 211/100 |
| 2,875,903 | 3/1959 | Shourds | 211/123 |
| 3,032,273 | 5/1962 | Spielman | 211/105.1 |
| 3,490,600 | 1/1970 | Reed et al. | 211/100 |
| 3,941,250 | 3/1976 | Ott | 211/100 |
| 4,114,764 | 9/1978 | Rich | 211/100 |
| 4,171,748 | 10/1979 | Fabian | 211/100 |
| 4,323,162 | 4/1982 | Steinhilber | 211/100 |
| 4,632,255 | 12/1986 | Kennedy | 211/100 |
| 4,717,053 | 1/1988 | Wang | 211/118 |
| 4,991,724 | 2/1991 | Wei | 211/88.04 |
| 5,011,029 | 4/1991 | Sugasawara et al. | 211/104 |
| 5,308,158 | 5/1994 | Vogelgesang et al. | 211/170 X |
| 5,373,950 | 12/1994 | Marc | 211/105.1 |
| 5,439,121 | 8/1995 | Agostoni | 211/100 |
| 5,695,072 | 12/1997 | Terragni | 211/1.51 |

FOREIGN PATENT DOCUMENTS

| | | |
|---|---|---|
| 624 326 | 11/1994 | European Pat. Off. . |
| 297 12 464 | 11/1997 | Germany . |
| 2 114 426 | 8/1993 | United Kingdom . |

*Primary Examiner*—Daniel P. Stodola
*Assistant Examiner*—Jennifer E. Novosad
*Attorney, Agent, or Firm*—Pillsbury Madison & Sutro

[57] ABSTRACT

An upwardly/downwardly movable clothes-hanger device which includes, for receiving the hung clothes, a support member (11) applied to at least one lever (12) extending from a linkage which is mounted on a supporting surface and by which lever (12) is movable between a raised substantially vertical or close to vertical position and a lowered substantially horizontal position. The linkage is housed in a seat (23) provided within the lever (12), which is preferably defined by two half-casings (20) joined together.

11 Claims, 8 Drawing Sheets

13
13
11
58
10
19
14
12
15
58
14
12
46
42

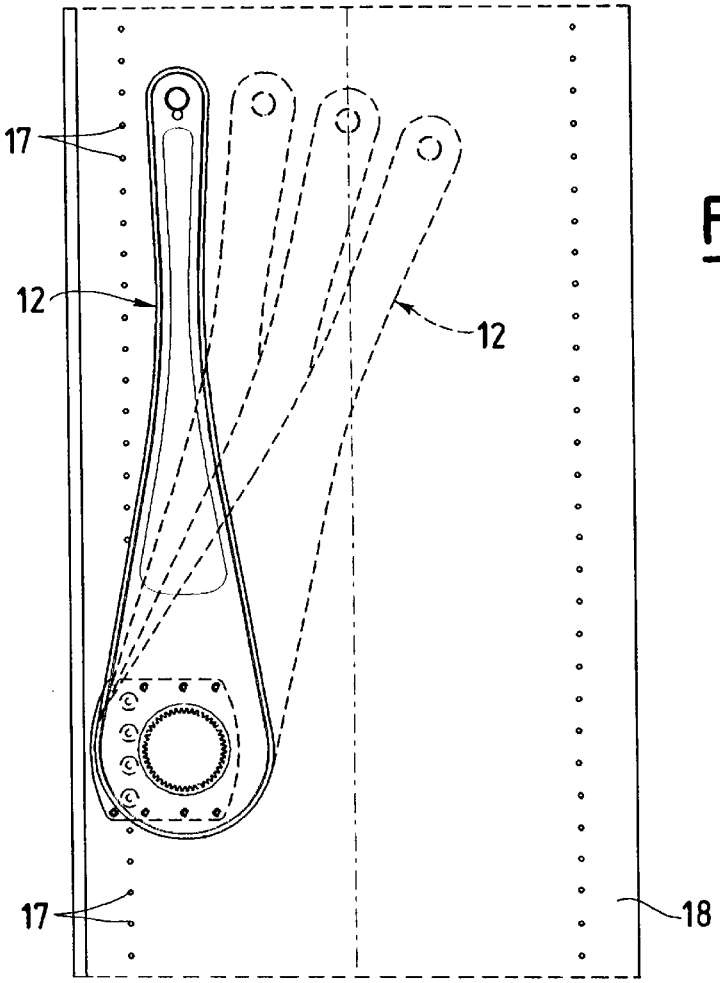
Fig.10
Fig.11
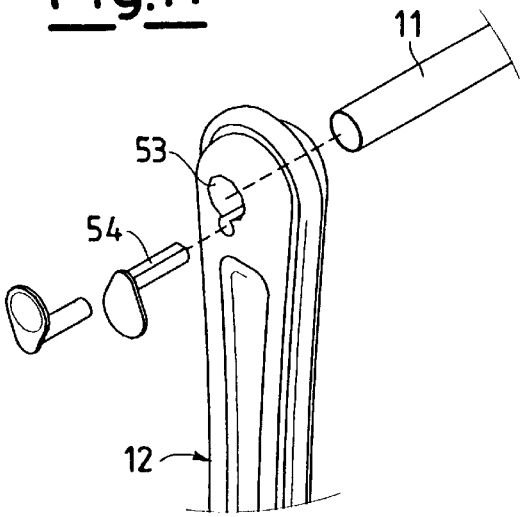
Fig.12
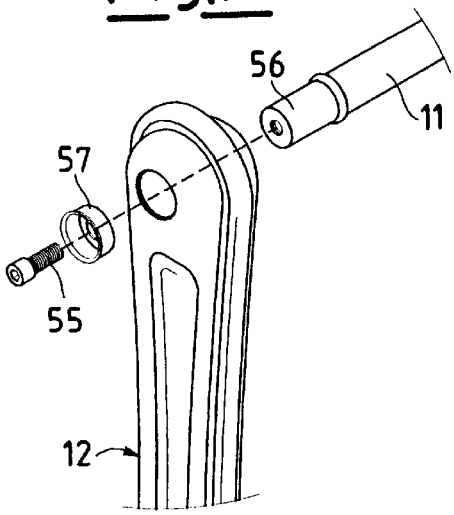

UPWARDLY/DOWNWARDLY MOVABLE CLOTHES-HANGER DEVICE

BACKGROUND OF THE INVENTION

This invention relates to important improvements in an upwardly/downwardly movable clothes-hanger device.

An upwardly/downwardly movable clothes-hanger device is known consisting of a horizontal tube to receive the hung clothes, which is applied to two lateral support levers extending from a suitable linkage contained in a box fixed to the sides of an item of furniture, to the side walls of a wall compartment or to another supporting surface.

The result is a very useful upwardly/downwardly movable device which if mounted in the top of a wardrobe conveys the clothes downwards and vice versa.

For this purpose, fixed to the tube there is a central gripping rod by which the user can manually move the clothes-hanger device both upwards and downwards.

Movement smoothness is achieved by balancing means cooperating with said lever movement linkages, which can also be motorized. A clothes-hanger device of this type is described for example in Italian industrial invention patent No. 849530, in Italian utility model patent No. 184156 and in EP 0741986, and is known commercially by the trademark "SERVETTO", registration Nos. 553123 and 553124.

BRIEF SUMMARY OF THE INVENTION

An object of the present invention is to design such an upwardly/downwardly movable clothes-hanger device for simpler and more rational production and assembly, and with the smallest possible number of components.

A further object of the present invention is to provide an upwardly/downwardly movable clothes-hanger of the aforesaid type in which the lever movement linkages are contained in an hermetically sealed casing and completely hidden from the user's view.

A further object of the present invention is to provide an upwardly/downwardly movable clothes-hanger comprising a single universal lever, ie usable on the right or on the left at choice. A further object of the present invention is to provide an upwardly/downwardly movable clothes-hanger having a structure such that the clothes encounter no obstacle along their path of movement.

A further object of the invention is to provide an upwardly/downwardly movable clothes-hanger constructed of a single plastic material, enabling it to be easily recycled. The aforesaid objects are attained by an upwardly/downwardly movable clothes-hanger device having the characteristics defined in the accompanying claims.

BRIEF DESCRIPTION OF THE SEVERAL VIEWS OF THE DRAWING

The structural and functional characteristics of the invention and its advantages over the known art will be more apparent from an examination of the description thereof given hereinafter with reference to the accompanying drawings, which show practical embodiments of the invention. On the drawings:

FIG. 10 is a front elevation showing the lever of FIG. 9 mounted on the side of a furniture item; and FIGS. 11, 12 are two perspective details showing respectively two possible methods of fixing the horizontal tube to the lever.

DETAILED DESCRIPTION OF THE INVENTION

Figure 1:
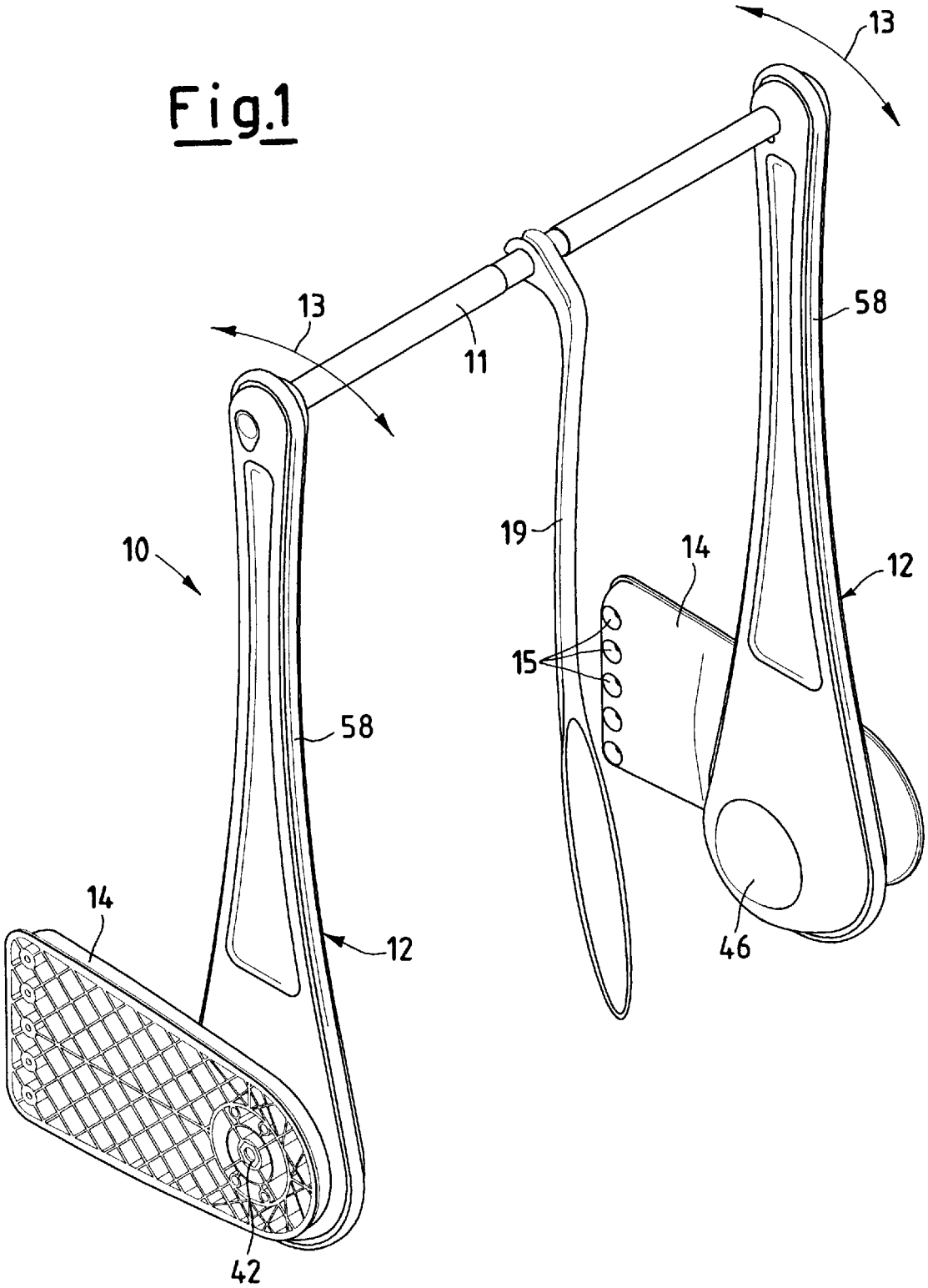
FIG. 1 is a perspective view showing one embodiment of the upwardly/downwardly movable clothes-hanger device of the invention.
Figure 2:
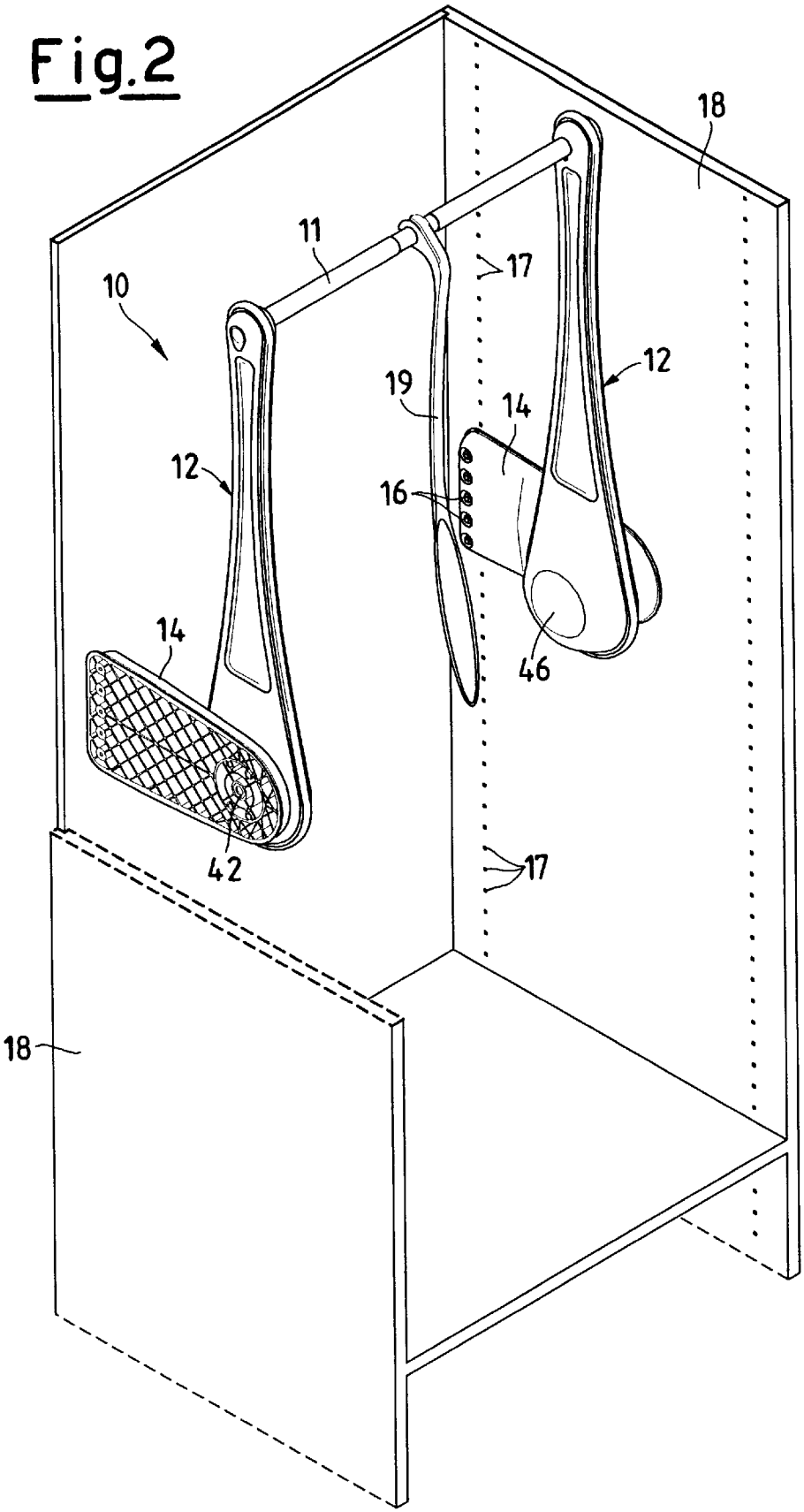
FIG. 2 is a perspective view showing the device of FIG. 1 mounted inside a wardrobe.

In FIGS. 1, 2 of the drawings, the reference numeral 10 indicates overall an example of an upwardly/downwardly movable clothes-hanger device comprising a horizontal tube 11 for receiving the hung clothes, which is applied to two lateral support levers 12 mounted rotatable in the directions of the arrows 13 on respective support plates 14. The plates 14 are of generally elongate rectangular shape with rounded corners, and at the opposite end to that on which the lever 12 is mounted comprise a series of holes 15 for screws 16 for fixing the plates 14 to holes 17, already provided as standard in the sides 18 of a furniture item.

The levers 12 are rotated downwards by a handle 19 fixed to the centre of the tube 11.

Figure 3:
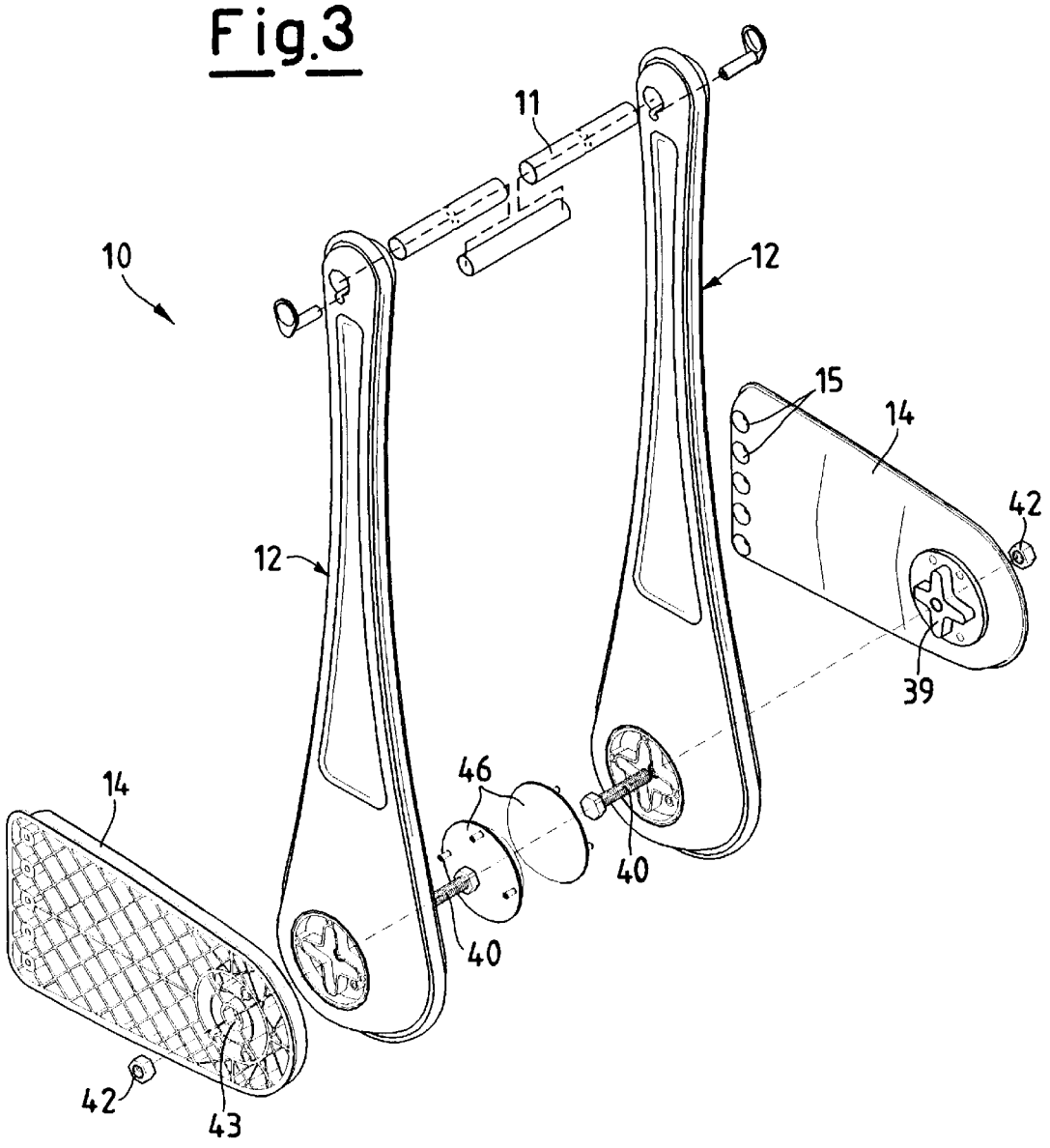
FIG. 3 is an exploded perspective view of the device of FIG. 1.
Figure 4:
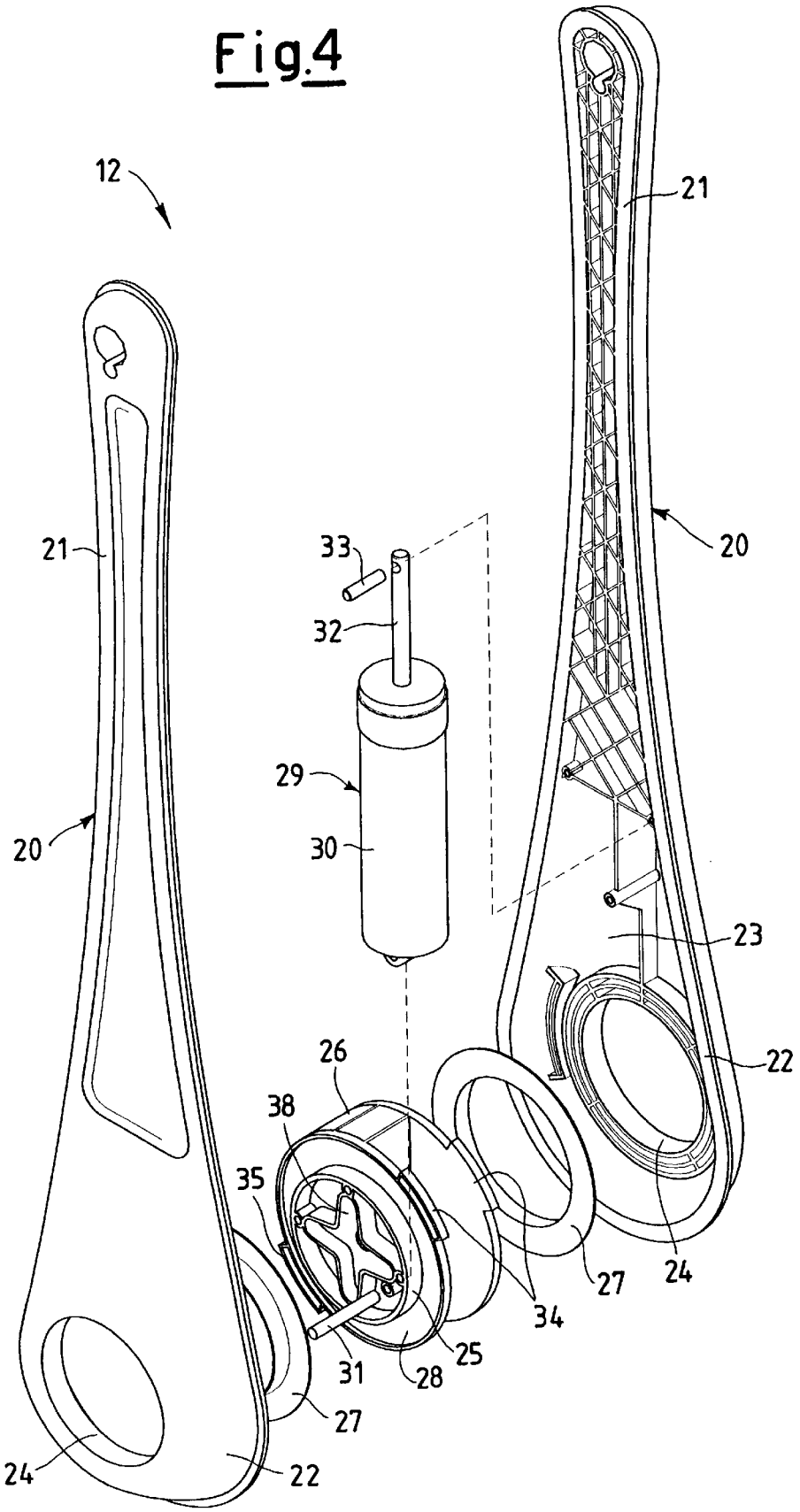
FIG. 4 is an exploded perspective view showing one of the support levers and the movement linkage contained in it.

With reference to FIGS. 3, 4 of the drawings, according to the invention each lever 12 is formed structurally from two mirror symmetrical half-casings 20, which comprise a ribbed first section 21 of narrow elongate configuration, which widens into a box-like second section 22 defining a seat 23 for the movement linkage for the lever 12 (FIG. 4).

In the seats 23 of the two half-casings 20 there are provided hubs 24 which rotatably engage annular collars 25 of a drum 26. Two annular anti-friction gaskets 27 are housed on respective seats 28 of said drum 26.

Figure 5:
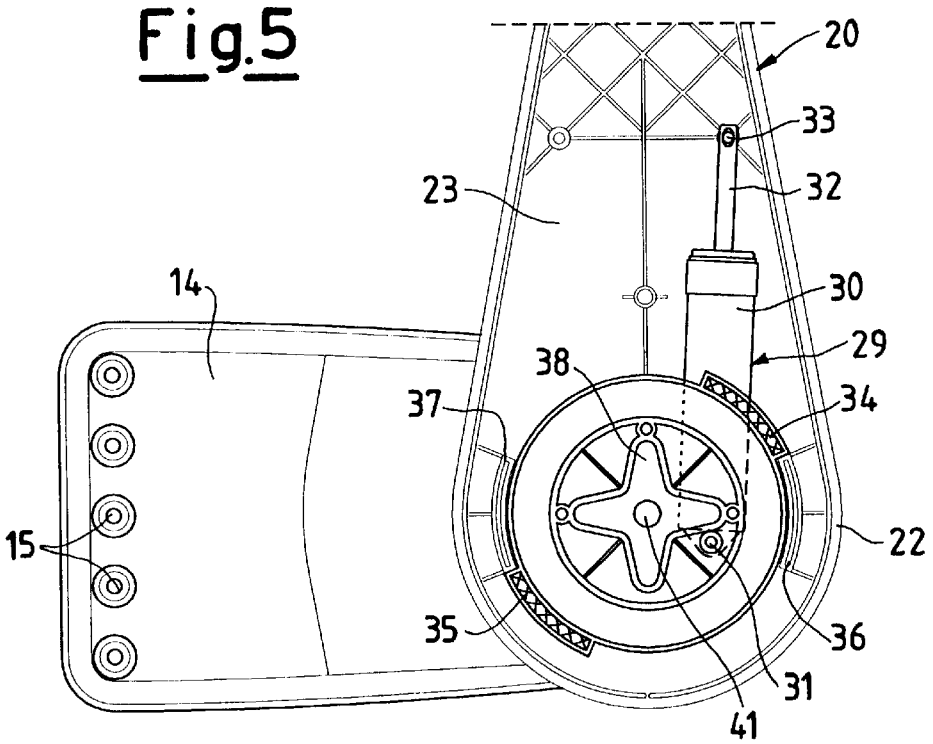
FIG. 5 is a detailed view showing the movement linkage in the condition in which the support lever is in the completely raised substantially vertical position.
Figure 6:
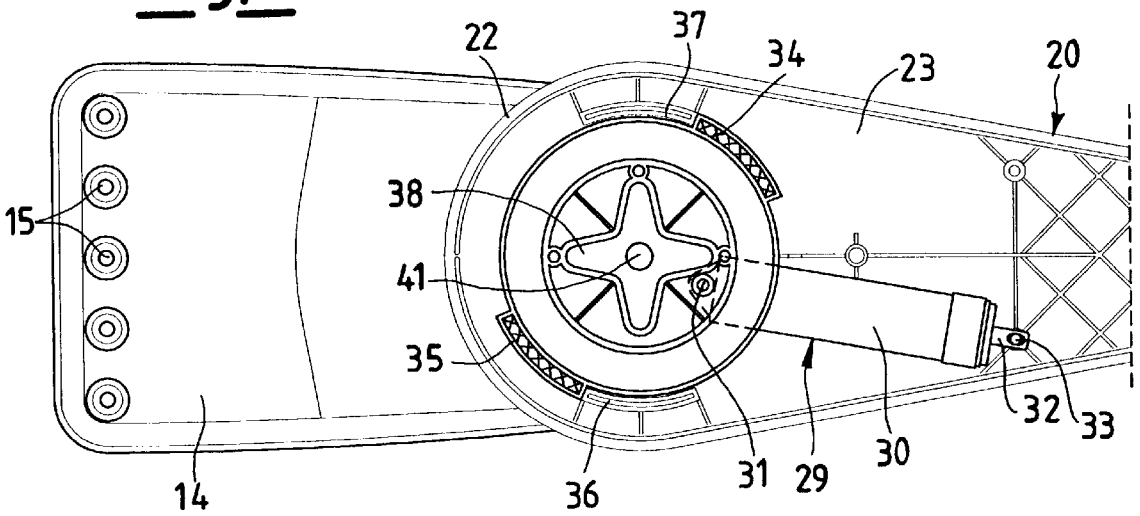
FIG. 6 is a detailed view similar to FIG. 5 but showing the movement linkage in the condition in which the support lever is in the completely lowered substantially horizontal position.

With the drum 26 there cooperates a fluid-containing piston unit 29 having its cylinder 30 pivoted by a pin 31 to the drum 26, and its rod 32 pivoted by a pin 33 to the half-casings 20 of the arm 12 (FIGS. 5, 6).

The drum 26 also comprises two pairs of teeth 34, 35 cooperating with respective limit stops 36, 37 on the half-casings 20 (FIGS. 5, 6).

The ends of the drum 26 comprise respective cross-shaped recesses 38 which engage complementary projections 39 on the plates 14. As can be clearly seen from FIG. 3 of the drawings, the drum 26 is rigidly fixed to the respective plate 14 by a bolt 40, which passes through an axial hole 41 FIGS. 5,6 in the drum 26 (FIG. 4) and is screwed into a nut 42 housed in a complementary seat 43 provided in the rear of the plate 14.

By this means, the drum 26 of each arm 12 is rigidly fixed to the respective plate 14, whereas the arm 12 can rotate on it between the raised position of FIG. 5 and the lowered position of FIG. 6.

The clothes-hanger device is lowered against the moderating action of the piston unit 29, which also provides smooth raising thereof. A cover 46 is snap-fitted to the outside of the hub 24 to hide the drum 26 from view.

Figure 7:
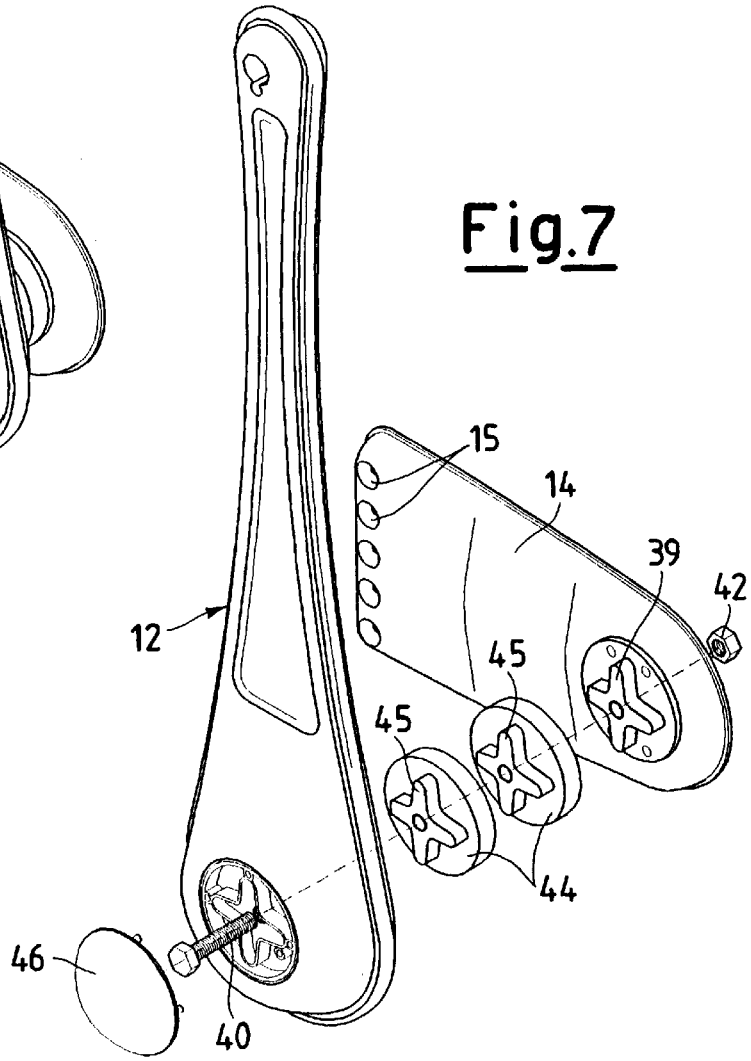
FIG. 7 is an exploded perspective view showing a support lever of the device of the invention equipped with a plurality of spacer elements, to position it at the required distance from the support wall.

The embodiment of FIG. 7 shows how the arm 12 can be spaced to a greater or lesser extent from the plate 14 and hence from the side of the furniture item or from any other type of wall, by using one or more cross-shaped spacer elements 44 provided internally with recesses complementary to the projection 39 on the plate 14, and externally with projections 45 complementary to the recesses 38 in the drum 26.

Figure 8:
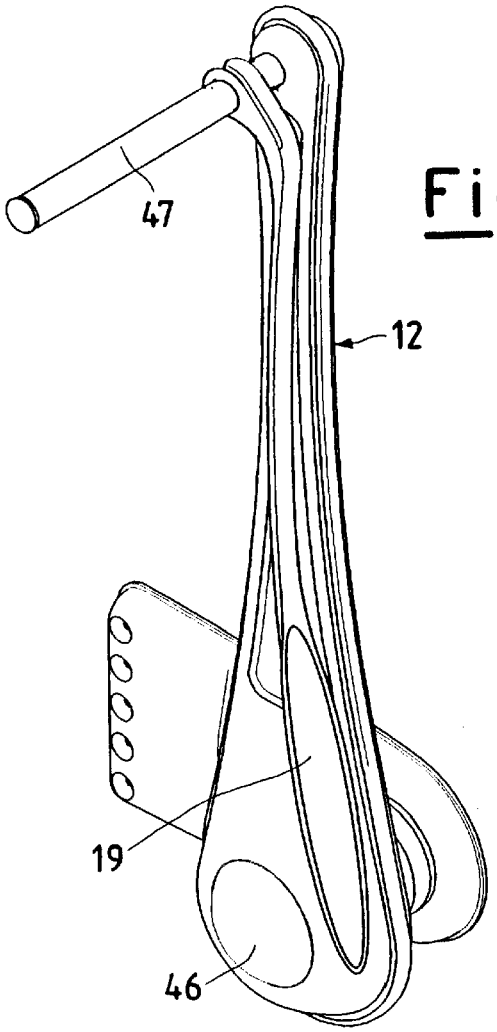
FIG. 8 is an exploded perspective view showing a second embodiment of the upwardly/downwardly movable clothes-hanger device provided with a single support lever.
Figure 9:
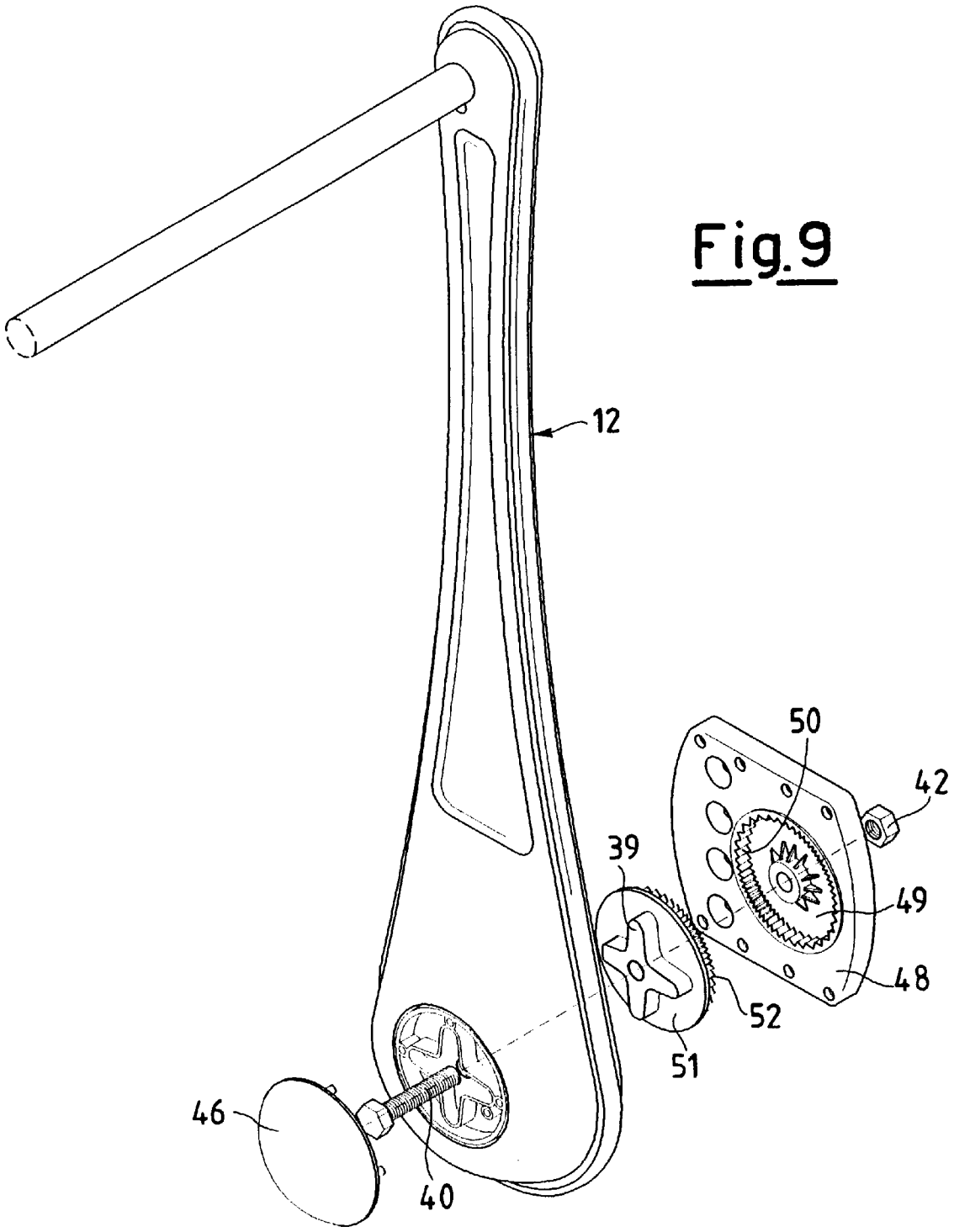
FIG. 9 is an exploded perspective view showing a further embodiment of the support lever according to the invention.

FIG. 8 shows how a single lever 12 can be mounted, from the free end of which there extends in the manner of a cantilever a horizontal rod 47 provided with an operating handle 19. FIGS. 9, 10 show a further possible embodiment of the invention, in which each lever 12 can be mounted on a suitable plate 48 at a desired inclination, as shown in FIG. 10.

For this purpose, the plate 48 has a cylindrical seat 49 with annular toothing 50 on which there engages a cover 51 with complementary toothing 52 and comprising on its exposed surface the cross-shaped projection 39 to engage the corresponding recess 38 in the drum 26 on which the arm 12 rotates.

It is apparent that, depending on the angular position of the cover 51 within the cylindrical seat 49 of the plate 48, the cross-shaped projection 39 assumes a different position corresponding to the desired inclination of the arm 12, as shown in FIG. 10.

Such an expedient enables the upwardly/downwardly movable clothes-hanger device to be installed in the standard rear hole system 17 of a wardrobe without the arms 12 interfering with the wardrobe roof, and also reduces the overall extension of the device with the levers 12 lowered, these projecting out of the wardrobe by a minimum distance, which also maintains the centre of gravity of the system as rearward as possible, preventing risk of toppling. Finally, FIGS. 11, 12 show two possible methods of fixing the horizontal tube 11 to the levers 12.

In FIG. 11 the free end of the tube 11 is inserted into a profiled through hole 53 in the lever 12, on which the tube 11 is locked with the aid of a key 54, as described in industrial invention patent application MI95A 001641 dated Jul. 27, 1995. Alternatively, the tube 11 can be fixed to the end of the lever 12 by a bolt 55, which is screwed into a threaded shank 56 provided at the end of the tube 11, with a retention cap 57 interposed therebetween.

Finally, the two constituent half-casings 20 of each lever 12 can be joined permanently together in a sealed manner by a perimetral seam 58 applied by the pressing method described and illustrated in industrial invention patent application No. MI95A 001642 dated Jul. 27, 1995.

From the teachings of the invention as heretofore described with reference to the figures, an upwardly/downwardly movable clothes-hanger device is obtained in which the movement linkage for each lever is advantageously contained hermetically within the lever itself, this making it completely hidden from view, while also preventing undesirable and dangerous liquid leakages, particularly in the case of cylinder rupture, even though rare.

Moreover, an upwardly/downwardly movable clothes-hanger device according to the invention is easily produced and assembled, it can be constructed of a single material (and hence easily recyclable), with a single universal lever (either right or left), and with the smallest possible number of components.

Finally, the suspended clothes encounter no obstacle within the compartment.

Again, as the levers rotate on a large-dimension hub, correct operation of the device with the passage of time is ensured, without the danger of jamming.

The objects stated in the introduction to the description are hence attained.

What is claimed is:

1. An upwardly/downwardly movable clothes-hanger device comprising:

a support member mountable on a supporting surface;

a lever mounted on said support member for movement between a raised position and a lowered position;

a hanger support carried by said lever; and movement control means for controlling movement of said lever between the raised and lowered positions, wherein said lever encloses a hollow interior defining a seat, and said movement control means are housed in said seat, characterised in that said lever comprises two half-casings (20) that are joined together.

2. A device as claimed in claim 1, characterised in that said half-casings (20) are mirror-symmetrical to one another.

3. A device as claimed in claim 1, characterised in that said half-casings (20) each comprise a first ribbed section (21) of narrow elongate configuration, which widens into a box-like second section (22) defining said seat (23).

4. An upwardly/downwardly movable clothes-hanger device comprising:

a support member mountable on a supporting surface;

at least one lever mounted on said support member for movement between a raised position and a lowered position;

a hanger support carried by said at least one lever; and movement control means for controlling movement of said at least one lever between the raised and lowered positions, wherein said at least one lever encloses a hollow interior defining a seat, and said movement control means are housed in said seat, characterized in that in said seat (23) there are provided hubs (24) which rotatably engage a drum (26).

5. A device as claimed in claim 4, characterised in that said drum (26) comprises annular collars (25) on which said hubs (24) rotatably engage.

6. A device as claimed in claim 4, characterised in that said drum (26) also comprises two pairs of teeth (34, 35) cooperating with respective limit stops (36, 37) on said at least one lever.

7. A device as claimed in claim 4, characterised in that said drum (26) is fixed to said support member.

8. A device as claimed in claim 4, characterised in that the ends of said drum (26) comprise respective cross-shaped recesses (38) which engage with complementary projections (39) on said support member.

9. A device as claimed in claim 4, characterised in that said movement control means comprise a fluid piston unit having a cylinder pivotally coupled to said drum and a piston rod pivotally connected to said at least one lever.

10. A device as claimed in claim 4, characterised in that: said support member comprises a plate provided with a seat for receiving a nut; said drum has an axial hole; and said device further comprises a bolt which extends through said hole in said drum to rigidly fix said drum to said plate, and a nut housed in said seat provided in said plate, said bolt being screwed into said nut.

11. A device as claimed in claim 4, wherein said support member comprises a plate having a cylindrical seat provided with annular teeth, and said device further comprises a cover having complementary teeth which engage said annular teeth, said cover having an exposed surface provided with a cross-shaped projection which engages in a corresponding recess in said drum.

* * * * *